US010423093B2

(12) United States Patent
Hara

(10) Patent No.: US 10,423,093 B2
(45) Date of Patent: Sep. 24, 2019

(54) IMAGE FORMING APPARATUS

(71) Applicant: CANON KABUSHIKI KAISHA, Tokyo (JP)

(72) Inventor: Yoshiaki Hara, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/138,211

(22) Filed: Sep. 21, 2018

(65) Prior Publication Data

US 2019/0094744 A1 Mar. 28, 2019

(30) Foreign Application Priority Data

Sep. 26, 2017 (JP) ..... 2017-184730

(51) Int. Cl.

| | |
|---|---|
| ***G03G 15/02*** | (2006.01) |
| ***G03G 15/08*** | (2006.01) |
| ***G03G 15/16*** | (2006.01) |
| ***G03G 15/01*** | (2006.01) |
| ***G03G 15/30*** | (2006.01) |
| ***G03G 15/00*** | (2006.01) |
| ***G03G 21/16*** | (2006.01) |

(52) U.S. Cl.

CPC ..... *G03G 15/0291* (2013.01); *G03G 15/0121* (2013.01); *G03G 15/0868* (2013.01); *G03G 15/167* (2013.01); *G03G 15/30* (2013.01); *G03G 15/50* (2013.01); *G03G 15/6597* (2013.01); *G03G 21/1652* (2013.01)

(58) Field of Classification Search

CPC ..... G03G 15/0291; G03G 15/0121; G03G 15/0868; G03G 15/167; G03G 15/30; G03G 15/6597

See application file for complete search history.

(56) References Cited

U.S. PATENT DOCUMENTS

| | | | | |
|---|---|---|---|---|
| 7,734,214 | B2 * | 6/2010 | Masuda | G03G 21/1619 399/107 |
| 9,103,399 | B2 * | 8/2015 | Miyakoshi | G03G 21/1619 |
| 9,420,131 | B2 | 8/2016 | Tani | |
| 2016/0132080 | A1 * | 5/2016 | Shen | G06F 1/187 361/679.33 |

FOREIGN PATENT DOCUMENTS

| | | |
|---|---|---|
| JP | 2016-57442 | 4/2016 |

* cited by examiner

*Primary Examiner* — Gregory H Curran
(74) *Attorney, Agent, or Firm* — Venable LLP

(57) ABSTRACT

An image forming apparatus includes a controller substrate, a first mounting portion for a first hard disk drive, a second mounting portion for a second hard disk drive, a first connector electrically connecting the controller substrate and the first hard disk drive, a second connector electrically connecting the controller substrate and the second hard disk drive. The second connector is shifted toward a side downstream of the first connector in a hard disk drive inserting direction so as to be prevented from overlapping with the first connector as seen in a vertical direction. In the second mounting portion, a through hole extending in the vertical direction is formed at a position where the through hole overlaps with the first connector as seen in the vertical direction.

19 Claims, 11 Drawing Sheets

IMAGE FORMING APPARATUS

FIELD OF THE INVENTION AND RELATED ART

The present invention relates to an image forming apparatus such as an electrophotographic copying machine, an electrophotographic printer or an ink jet printer.

In recent years, in the image forming apparatus, colorization and speed-up have been advanced, so that a mass storage device capable of storing and reading high-volume image data at high speed has become a high necessity. In the storage device, the light-volume image data is accumulated, and therefore, from a viewpoint of confidentially of the accumulated data, there are user needs such that the storage device is periodically extracted from a main assembly of the image forming apparatus and then is stored. In order to meet the user needs, in the image forming apparatus, a constitution in which a hard disk drive (hereinafter, referred to as a "HDD") which is mountable in and demountable from the main assembly of the image forming apparatus by being inserted into and extracted from the main assembly of the image forming apparatus has been employed in many cases.

Japanese Laid-Open Patent Application (JP-A) 2016-57442 discloses a constitution in which as shown in FIG. 11, in an electrical unit 74 which is projected upwardly from an upper surface of a main assembly of an image forming apparatus B on a rear side, two HDDs 72a and 72b capable of being mounted, in and demounted from the electrical unit 74 are provided and arranged in a vertical direction.

In the image forming apparatus, an opportunity to add a user-desired function later as an option increases, and in some cases, as the option, a connector for electrically connecting a HDD and a controller substrate of an image forming apparatus is exchanged. Incidentally, a constitution in which the hard disk drive or the connector is capable of being exchanged by not only a service person but also the user himself (herself) is called a removable option.

However, as disclosed in JP-A 2016-57442, in the case where the two HDDs 72a and 72b are provided and arranged in the vertical direction, depending on a fixing method of the connector, an exchange property of the connector becomes poor. Particularly, in the case where the HDD is fixed to upper and lower mounting frames with screws from the vertical direction, when the screws are hidden between the upper and lower mounting frames, in order to access the screws, the connectors are required to be demounted together with the frames, so that the exchange property of the connector becomes worse.

SUMMARY OF THE INVENTION

The present invention has been accomplished in view of the above-described circumstances. A principal object of the present invention is to provide an image forming apparatus in which a plurality of hard disk drives are mountable by being arranged in a vertical direction and which is capable of improving an exchange property of connectors for electrically connecting the hard disk drives and a controller substrate.

According to an aspect of the present invention, there is provided an image forming apparatus comprising: a controller substrate configured to control an image forming portion for forming an image; a first mounting portion configured to mount a first hard disk drive for storing data by inserting the first hard disk drive into the first mounting portion in a horizontal direction; a second mounting portion provided partly overlapping with the first mounting portion as seen in a vertical direction and configured to mount a second hard disk drive for storing data by inserting the second hard disk drive in the same direction as an inserting direction of the first hard disk drive into the first mounting portion; a first connector configured to electrically connect the controller substrate and the first hard disk drive mounted in the first mounting portion, at a position downstream of the first hard disk drive with respect to the inserting direction, the first connector being fastened to the first mounting portion with a screw threaded in the vertical direction; and a second connector configured to electrically connect the controller substrate and the second hard disk drive mounted in the second mounting portion, at a position downstream of the second hard disk drive with respect to the inserting direction, the second connector being fastened to the second mounting portion with a screw threaded in the vertical direction, wherein the second connector is shifted toward a side downstream of the first connector in the inserting direction so as to be prevented from overlapping with the first connector as seen in the vertical direction, wherein in the second mounting portion, a through hole extending in the vertical direction is formed at a position where the through hole overlaps with the first connector as seen in the vertical direction.

Further features of the present invention will become apparent from the following description of exemplary embodiments with reference to the attached drawings.

DESCRIPTION OF EMBODIMENTS

First Embodiment

<Image Forming Apparatus>

In the following, first, a general structure of an image forming apparatus according to First Embodiment of the present invention will be described together with an operation during image formation with reference to the drawings. Incidentally, as regards dimensions, materials, shapes and relative arrangement of constituent elements described in the following embodiments, the scope of the present invention is not intended to be limited thereto unless otherwise specified.

Figure 1:
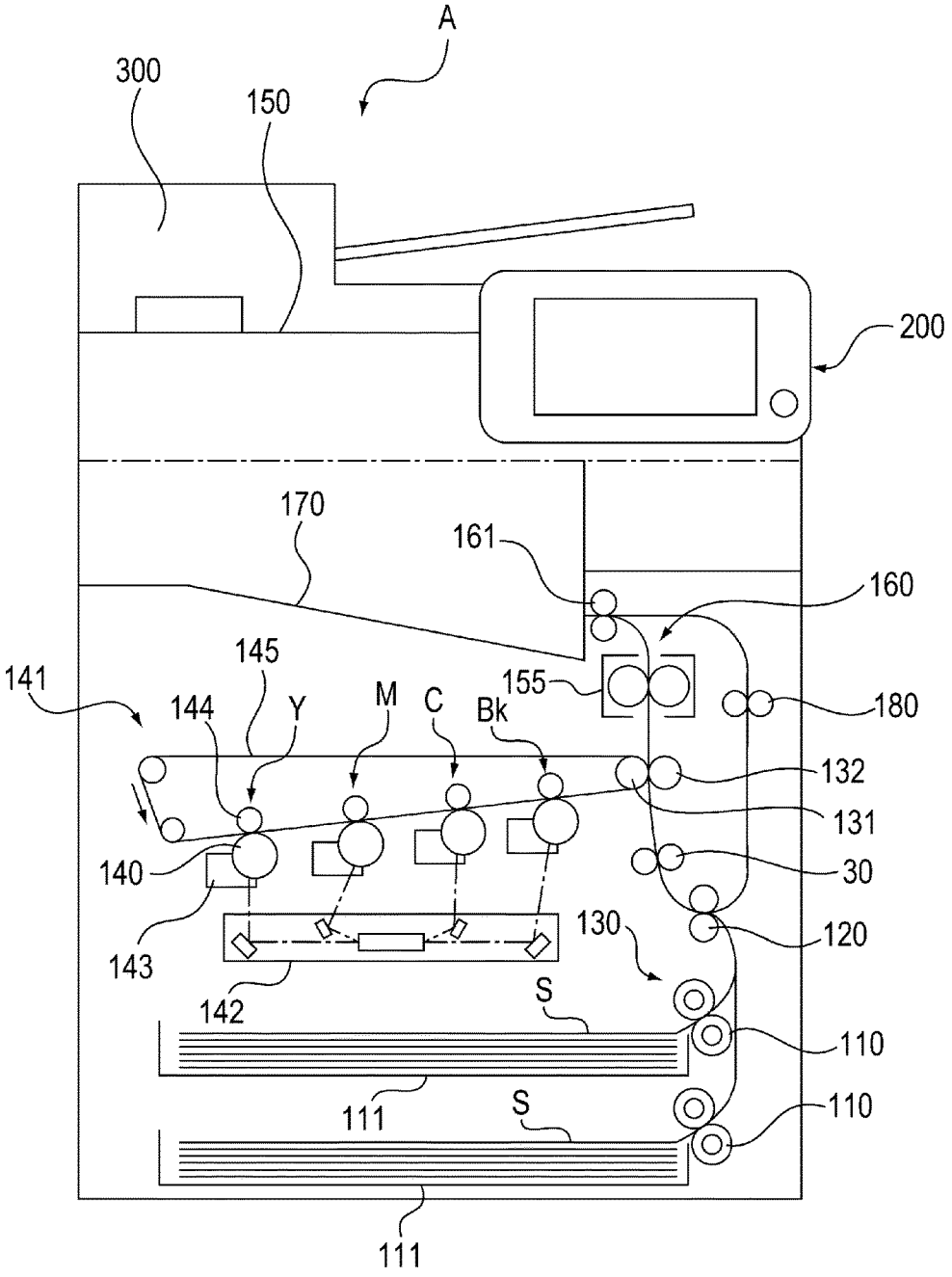
FIG. 1 is a schematic sectional view of an image forming apparatus.

FIG. 1 is a schematic sectional view of an image forming apparatus A according to this embodiment. As shown in FIG. 1, the image forming apparatus A is a full-color laser printer for forming an image on a sheet with toners of four colors of yellow, magenta, cyan and black. The image forming apparatus A includes an image forming portion 141 for forming the image on the sheet by transferring a toner image onto the sheet, a sheet feeding portion 130 for feeding the sheet toward the image forming portion 141, and a fixing portion 160 for fixing the toner image on the sheet.

The image forming portion 141 includes image forming stations Y, M, C and Bk for forming color toner images with the above-described respective toners. The image forming portion 141 further includes a laser scanner unit 142, an intermediary transfer belt 145, a secondary transfer roller 132, a secondary transfer opposite roller 131 and the like.

Each of the image forming stations Y, M, C and Bk includes a photosensitive drum 140, a charging device (not shown), a developing device 143, and a primary transfer roller 144. Incidentally, the image forming stations Y, M, C and Bk use the toners of yellow, magenta, cyan and black, respectively, and have the same constitution except for the colors of the toners used.

At an upper portion of the image forming apparatus A, a feeder 300 is provided, and under the feeder 300, an image reading portion 150 for reading an image of an original is provided. Further, on a front surface side of the image forming apparatus A, an operating portion 200 is provided. A user operates the operating portion 200, so that the user can provide a reading instruction of image information of the original to the image reading portion 150. The read image information is processed by a controller substrate 610 (FIG. 3) on which a CPU or the like is mounted as a controller of the image forming apparatus A. Incidentally, the controller substrate 610 carries out control of an entirety of the image forming apparatus A, such as control of respective members of the image forming portions 141, in addition to processing of the image information.

Next, an image forming operation will be described. First, when the controller substrate 610 shown in FIG. 3 receives an image forming job, a sheet S stacked and accommodated in a sheet cassette 111 is sent to a registration roller pair 30 by a feeding roller pair 110 and a conveying roller pair 120. Then, the sheet S is subjected to oblique movement correction and timing correction by the registration roller pair 30, and thereafter is sent to a secondary transfer portion formed between the secondary transfer roller 132 and the secondary transfer opposite roller 131.

On the other hand, in the image forming portion 141, first, the surface of the photosensitive drum 140 is electrically charged by the charging device (not shown). Thereafter, image data of the original read by the image reading portion 150 and image data sent from an unshown external device or the like are processed by the controller substrate 610, and depending on a result of processing thereof, the surface of each of the photosensitive drums 140 for the respective colors is irradiated with laser light by the laser scanner unit 142. As a result, on the surface of the photosensitive drum 140, an electrostatic latent image depending on the image data is formed.

Thereafter, a toner image is formed on the surface of the photosensitive drum 140 by depositing toner of an associated color on the electrostatic latent image, formed on the surface of the photosensitive drum 140, by the developing device 143. As a result, toner images formed on the surfaces of the respective photosensitive drums 140 are primary-transferred onto an intermediary transfer belt 145 by applying a primary transfer bias to primary transfer rollers 144. As a result, a full-color image is formed on the surface of the intermediary transfer belt 145.

Thereafter, the intermediary transfer belt 145 is rotated by rotation of the secondary transfer opposite roller 131 which received a driving force from an unshown driving source, so that the toner image is sent to a secondary transfer portion. Then, at the secondary transfer portion, the toner image on the intermediary transfer belt 145 is transferred onto the sheet S by applying a secondary transfer bias to the secondary transfer roller 132.

Then, the sheet S on which the toner image is transferred is subjected to a heating and pressing treatment by a fixing device 155, whereby the toner image is fixed on the sheet S. Thereafter, the sheet S on which the toner image is fixed is discharged onto a discharge tray 170 by a discharging roller pair 161.

Incidentally, in the case where images are formed on both surfaces of the sheet S, the sheet S subjected to a fixing process of the toner image by the fixing device 155 is sent to a conveying roller pair 180 for double-side printing by the discharging roller pair 161 rotating in a direction opposite to a direction in the case where the image is formed on one surface. Thereafter, the sheet S is sent from the conveying roller pair 180 for double-side printing toward the conveying roller pair 120 and then toward the registration roller pair 30. Thereafter, the sheet S is sent again to the image forming portion in a state in which the sheet S is turned upside down, so that the image is similarly formed on a back surface of the sheet S in the image forming portion 141.

<Controller Box>

Next, a controller box 600 provided inside an outer casing cover (not shown) at a rear surface of the image forming apparatus A will be described.

Figure 2:
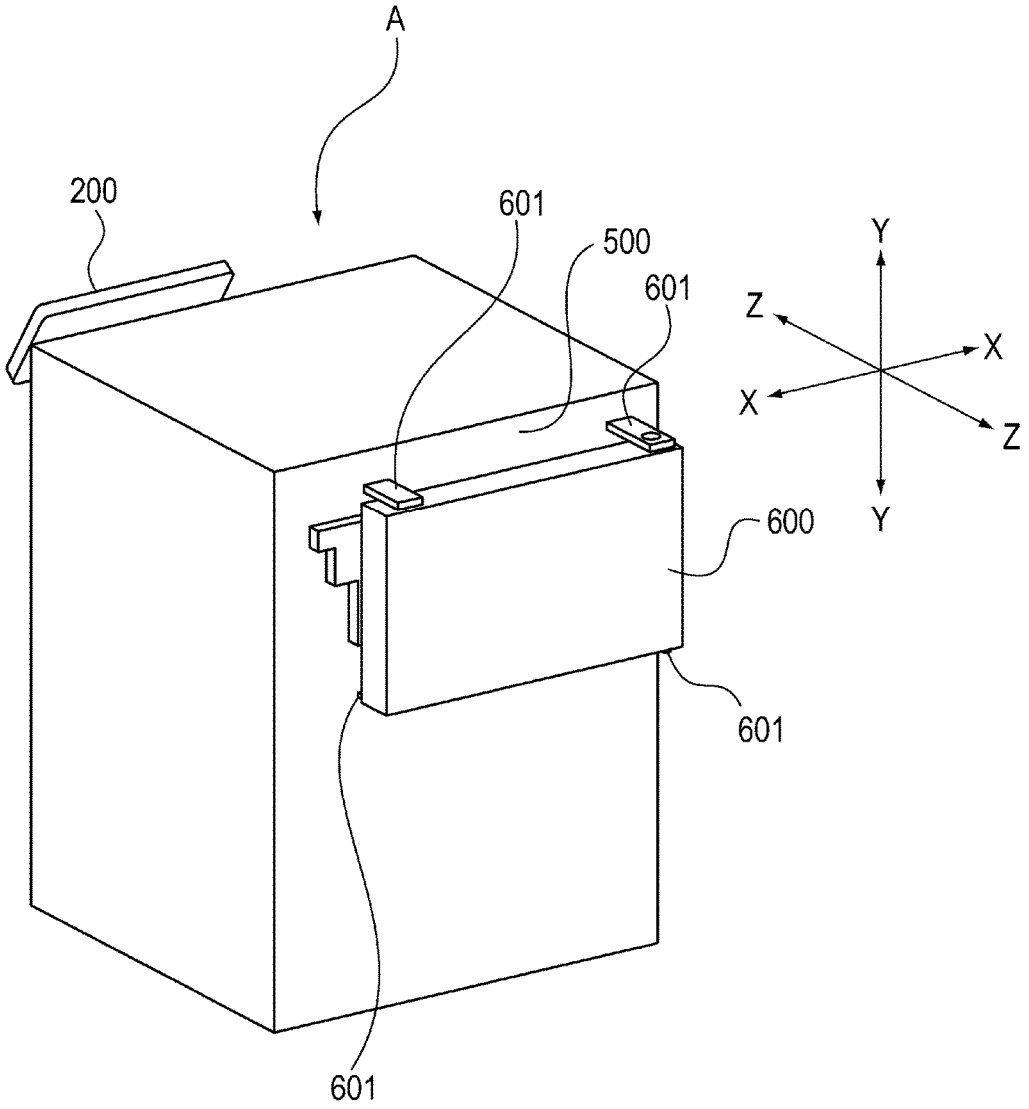
FIG. 2 is a schematic perspective view of the image forming apparatus.
Figure 3:
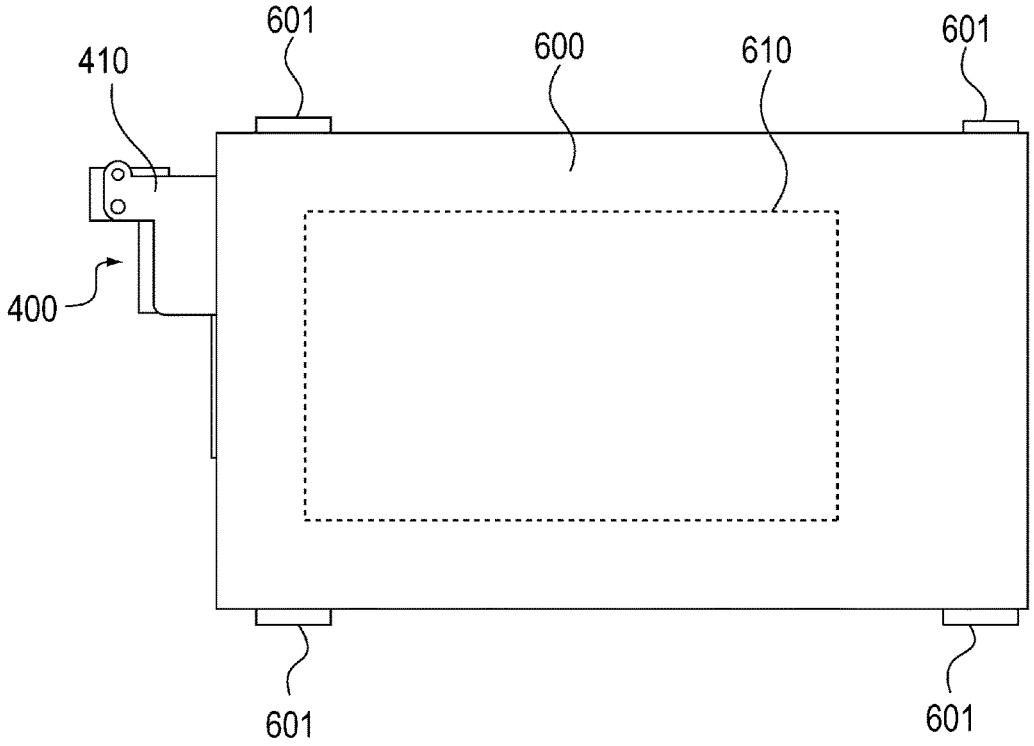
FIG. 3 is a schematic view showing a controller box as seen from a rear surface side of the image forming apparatus.

FIG. 2 is a schematic perspective view showing the image forming apparatus A in a state in which the feeder 300 and the outer casing cover (not shown) are demounted, as seen from a rear surface side of the image forming apparatus A. FIG. 3 is a schematic view showing the controller box 600 as seen from the rear surface side of the image forming apparatus A. In the following description, a horizontal direction in an arrow X direction shown in FIG. 2 and a vertical direction is an arrow Y direction shown in FIG. 2.

As shown in FIGS. 2 and 3, the controller box 600 is mounted on a frame 500 on the rear surface side of the main assembly of the image forming apparatus A by mounting arms 601. The controller box 600 accommodates therein the controller substrate 610 on which the CPU or the like is mounted. Further, to the controller box 600, an HDD unit 400 for mounting HDDs is mounted.

Figure 4:
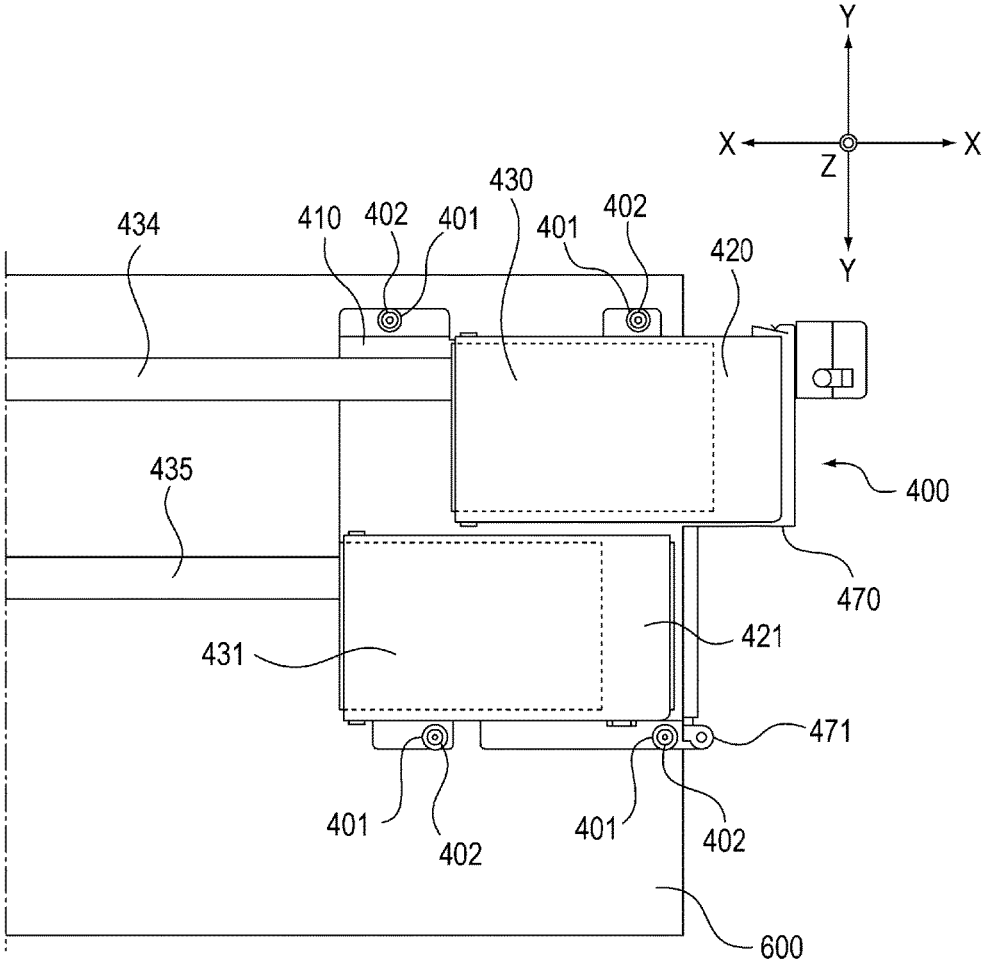
FIG. 4 is an enlarged view of an HDD unit.

FIG. 4 is an enlarged view of the HDD unit 400. FIG. 4 is a schematic view showing the HDD unit 400 as seen from a front surface side of the image forming apparatus A.

As shown in FIG. 4, the HDD unit 400 includes a supporting metal plate 410 fixed to the controller box 600 with screws 402 through dampers 401 is provided with a supporting shaft 471 for rotatably shaft-supporting a door 470 (cover member).

Further, to the supporting metal plate 410, a guide frame 420 (first mounting portion) for mounting a HDD 430 as a first hard disk drive for storing data is fixed with unshown screws. The hard disk drive 430 is mounted into and demounted from the guide frame 420 by being inserted into and extracted from the guide frame 420.

Further, to the supporting metal plate 410, a guide frame 421 (second mounting portion) for mounting a HDD 431 as a second hard disk drive for storing data is fixed with unshown screws while being arranged with the guide frame 420 in the vertical direction. The hard disk drive 431 is mounted into and demounted from the guide frame 421 by being inserted into and extracted from the guide frame 421. Specifically, the HDD 431 is mounted in the guide frame 421 by being inserted from the same direction (arrow K1 direction shown in FIG. 6) as an inserting direction in which the HDD 430 is inserted into the guide frame 420.

Figure 5:
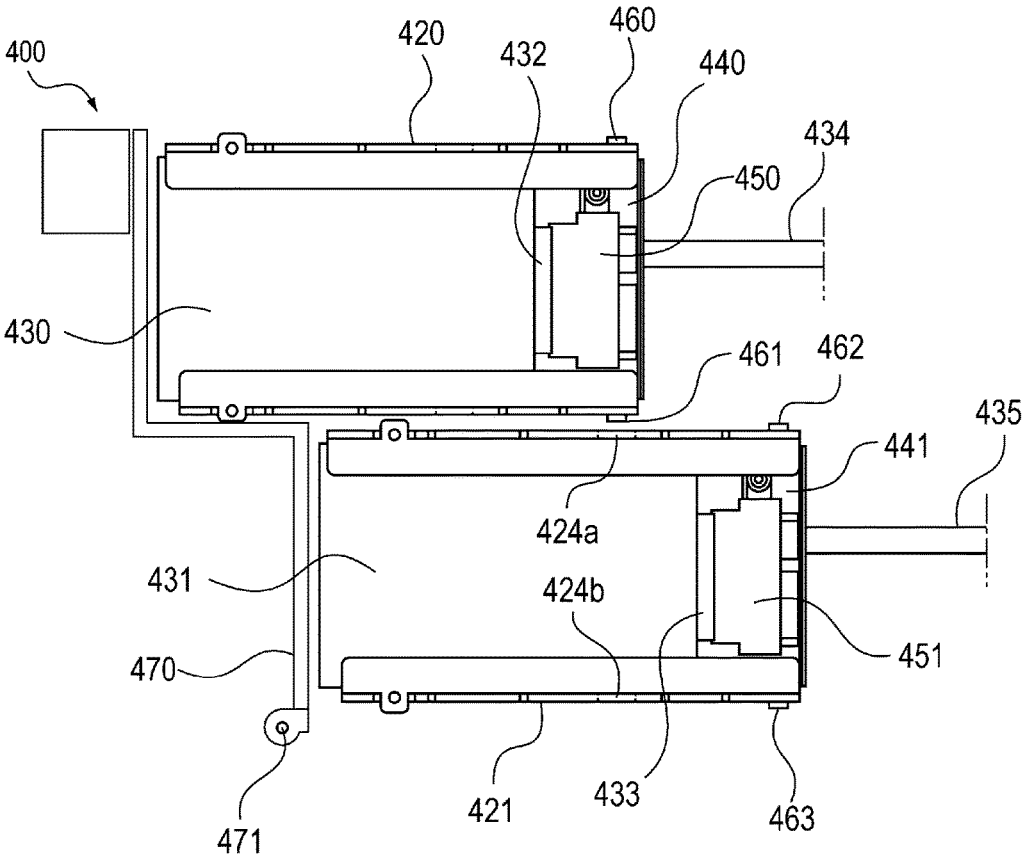
FIG. 5 is a schematic view showing the HDD unit in a state in which ha door is closed as seen from the rear surface side of the image forming apparatus.

Each of the hard disk drives 430 and 431 includes a casing in which a disk-shaped platter (not shown) for storing data, an access arm (not shown) for accessing data stored in the platter, and the like are provided. The access arm accesses the data stored in the platter by a magnetic head mounted thereto at a free end thereof. At end portions of the HDDs 430 and 431 with respect to the inserting direction, connector connecting portions 432 and 433 which are exposed from the casings and which are constituted by interface connectors and voltage source connectors are provided, respectively. The connector connecting portions 432 and 433 are connected with connectors 450 and 451, respectively, described later by being inserted into the connectors 450 and 451, respectively (FIG. 5).

Figure 8:
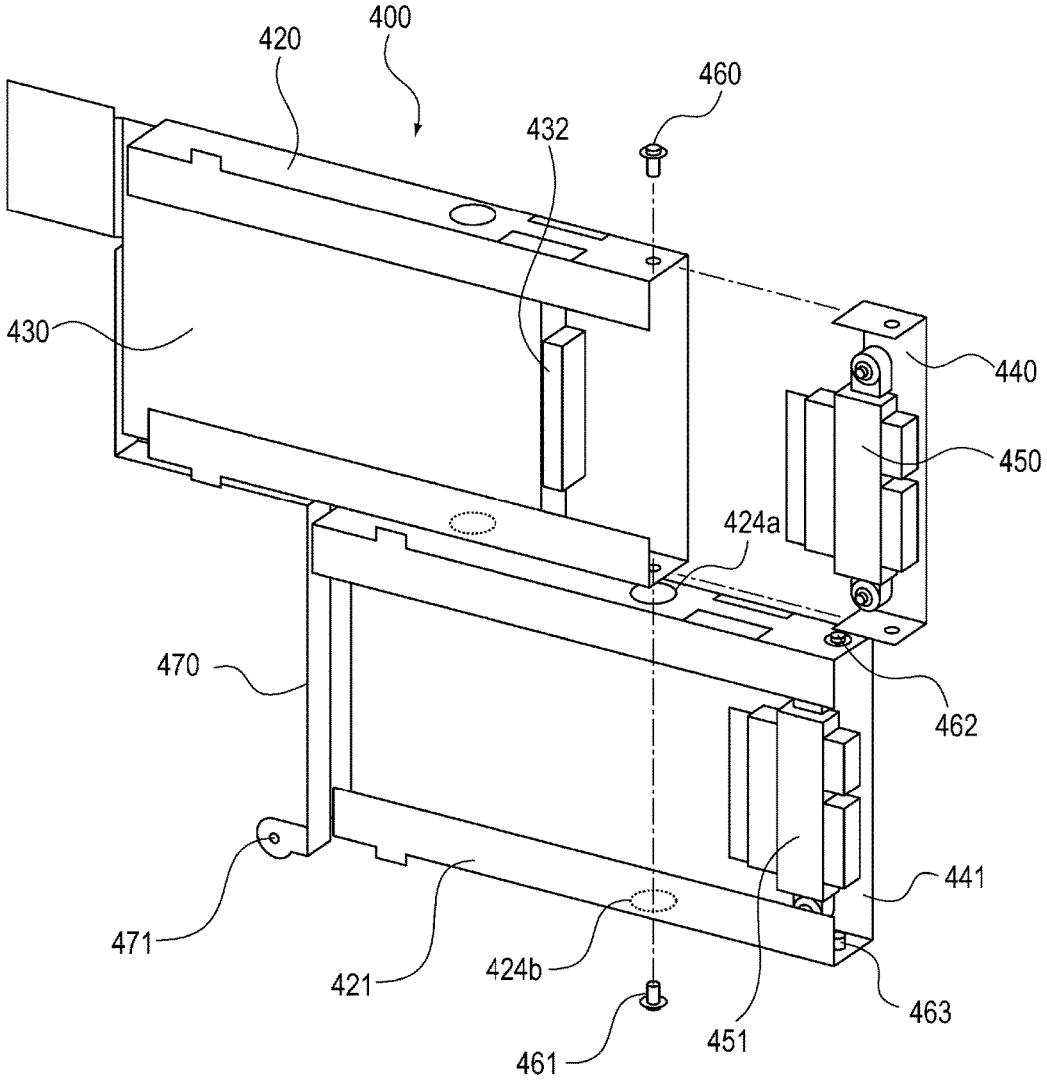
FIG. 8 is a perspective view of the HDD unit when a connector metal plate is demounted from a guide frame.

The guide frames 420 and 421 are constituted metal plates and have shapes such that the guide frames 420 and 421 are bent so as to enclose the HDDs 430 and 431, respectively. Thus, the shapes of the guide frames 420 and 421 are made so as to enclose the HDDs 430 and 431, respectively, so that when the HDDs 430 and 431 can be guided in an insertion and extraction direction when the HDDs 430 and 431 are inserted into end extracted from the guide frames 420 and 421. For this reason, the connector connecting portions 432 and 433 of the HDDs 430 and 431 described later are readily inserted into the connectors 450 and 451, respectively. Further, top (upper) surfaces and lower surfaces, extending in the horizontal direction, of the guide frames 420 and 421 are provided with screw holes for inserting therein screws 460 to 463 (FIG. 8).

Incidentally, in this embodiment, a constitution in which each of the guide frames 420 and 421 is connected with the supporting metal plate 410 as separate members is employed. However, the present invention is not limited thereto, but these members may also be formed from a single metal plate by press work or the like.

The guide frames 420 and 421 are constituted by members having the same shape and are disposed at different positions with respect to the horizontal direction. For that reason, the HDD 430 mounted in the guide frame 420 and the HDD 431 mounted in the guide frame 421 are disposed at positions shifted in the horizontal direction. Specifically, an upstream end surface of the HDD 431 mounted in the guide frame 421 with respect to the inserting direction is disposed at a position shifted to a side downstream, with respect to the inserting direction of the hard disk drive 431, of an upstream end surface of the HDD 430 mounted in the guide frame 420 with respect to the inserting direction.

Thus, when the two HDDs 430 and 431 are arranged in the vertical direction, by disposing the HDDs 430 and 431 while shifting positions thereof in the horizontal direction, heat is readily dissipated from a portion where the HDDs 430 and 431 do not overlap with each other as seen in the vertical direction, so that temperature rise of both hard disk drives can be suppressed.

Figure 6:
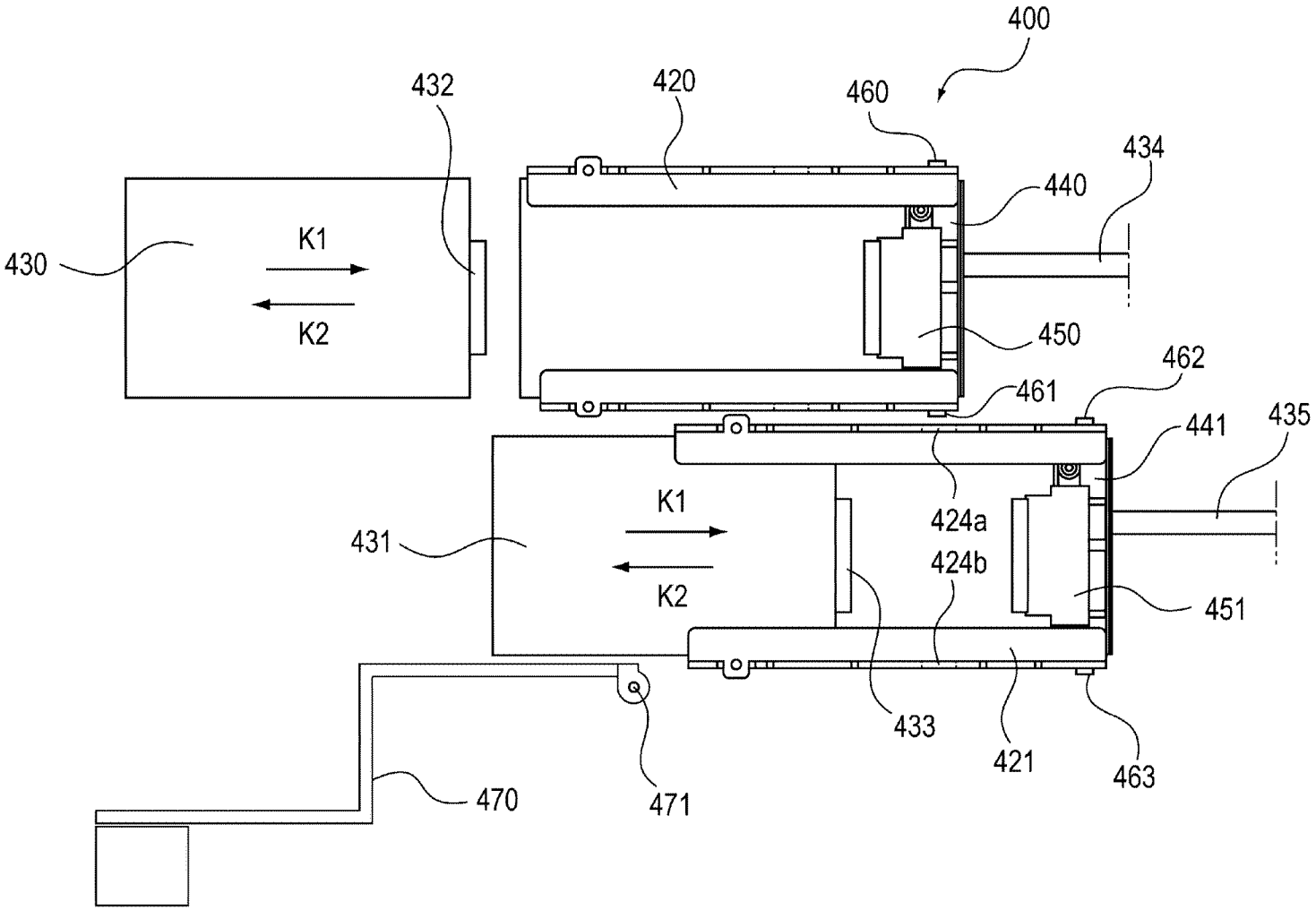
FIG. 6 is a schematic view showing the HDD unit in a state in which the door is open as seen from the rear surface side of the image forming apparatus.

FIG. 5 is a schematic view showing the HDD unit 400 as seen from the rear surface side of the image forming apparatus A in a state in which the door 470 is closed. FIG. 6 is a schematic view showing the HDD unit 400 as seen from the rear surface side of the image forming apparatus A in a state in which the door 470 is open. Here, in FIGS. 5 and 6, for convenience of explanation, the supporting metal plate 410 is shown in a see-through state.

As shown in FIGS. 5 and 6, the door 470 has a shape such that a stepped portion is formed with respect to the horizontal direction so as to extend along positions of the upstream end surfaces of the HDDs 430 and 431 with respect to the inserting direction and an uneven shape of outer end portions of the guide frames 420 and 421. Further, when the door 470 is in a closed position, the door 470 covers the HDD 430 mounted in the guide frame 420 and the HDD 431 mounted in the guide frame 421. Further, when the door 470 is in an open position, the guide frames 420 and 421 are exposed, so that the HDDs 430 and 431 can be inserted into an extracted from the guide frames 420 and 421, respectively, in the arrow K1 direction and an arrow K2 direction, respectively. The door 470 is rotated about the supporting shaft 471 as a rotation center, and is moved between the closed position and the open position.

The supporting shaft 471 which is the rotation center of the door 470 is disposed below the guide frame 421 and is disposed on a side downstream, with respect to the inserting direction, of the upstream end surface of the HDD 430 mounted in the guide frame 421 with respect to the inserting direction. For this reason, only by rotating the door 470 by 90°, the door 470 can be escaped from an insertion and extraction locus of the HDDs 430 and 431, so that insertion and extraction of the HDDs 430 and 431 can be performed.

That is, if the supporting shaft 471 which is the rotation center of the door 470 is disposed at a position above the guide frame 420, the door 470 and the insertion and extraction locus of the HDD 430 overlap with each other when the door 470 is merely rotated by 90°, so that further rotation of the door 470 is required for insertion and extraction of the HDD 430. However, by employing the arrangement of the supporting shaft 471 in this embodiment, the HDDs 430 and 431 can be inserted into and extracted from the guide frames 420 and 421 in a state in which a rotation angle of the door 470 is small, so that operativity is improved and space saving can be realized.

Further, a shape of the door 470 on a side of the HDDs 430 and 431 extends along end surfaces of the HDDs 430 and 431. For this reason, in the case where insertion amounts of the HDDs 430 and 431 are insufficient with respect to the connectors 450 and 451 connected during mounting of the HDDs 430 and 431, when the door 470 is closed, the door 470 abuts against the end surfaces of the HDDs 430 and 431. For this reason, it is possible to notify an operator of insufficient insertion of the HDDs 430 and 431. Further, the door 470 is further closed in a state in which the door 470 abuts against the HDDs 430 and 431, so that the HDDs 430 and 431 can be inserted into the connectors 450 and 451 by the door 470. Accordingly, it is possible to suppress improper connection due to improper insertion of the HDDs 430 and 431.

<Connector>

Next, the connectors 450 and 451 for electrically connecting the HDDs 430 and 431, respectively, with the controller substrate 610 will be described.

As shown in FIGS. 5 and 6, on a side downstream of the HDD 430 mounted in the guide frame 420 with respect to the inserting direction, a connector metal plate 440 for holding the connector 450 (first connector) is fastened to the guide frame 420 with screws 460 and 461 from the vertical direction. The connector 450 is connected with the connector connecting portion 432 provided on a side downstream of the HDD 430 with respect to the inserting direction of the HDD 430 and electrically connects the HDD 430 and the controller substrate 610 through a cable 434.

Similarly, on a side downstream of the HDD 431 mounted in the guide frame 421 with respect to the inserting direction, a connector metal plate 441 for holding the connector 451 (second connector) is fastened to the guide frame 421 with the screws 462 and 463 from the vertical direction. The connector 451 is connected with the connector connecting portion 433 provided on a side downstream of the HDD 431 with respect to the inserting direction of the HDD 431 and electrically connects the HDD 431 and the controller substrate 610 through a cable 435.

The connector metal plates 440 and 441 have shapes bent for enclosing the connectors 450 and 451, respectively, top (upper) surfaces and lower surfaces, extending in the horizontal direction, of the connector metal plates 440 and 441 are provided with screw holes for inserting therein the screws 460 and 463 (FIG. 8). The top surfaces and lower surfaces of the connector metal plates 440 and 441 and the top surfaces and lower surfaces of the guide frames 420 and 421 are disposed so as to overlap with each other, and the screw holes provided at the respective surfaces communicate with the associated screw holes, respectively, and the screws 460 and 463 are inserted into the associated screw holes, respectively (FIG. 8).

Further, the connector 451 is shifted to a side downstream of the connector 450 with respect to the inserting direction of the hard disk drive 431 so as to be prevented from overlapping with the connector 450 as seen in the vertical direction. The guide frame 421 is provided with through holes 424*a* and 424*b* extending in the vertical direction at positions where the through holes 424*a* and 424*b* overlap with the connector 450 as seen in the vertical direction. The through holes 424*a* and 424*b* are formed in the top surface and the lower surface, respectively, of the guide frame 421 at the same positions with respect to the horizontal direction.

Here, the connectors 450 and 451 are constituted so as to be simply exchangeable. In the following, a procedure when the connectors 450 and 451 are exchanged will be described.

First, the exchange of the connector 451 will be described. When the connector 451 is exchanged, the controller box 600 is demounted from the frame 500 by operating the mounting arms 601 (FIG. 2). Then, the screws 462 and 463 for fixing the guide frame 421 and the connector metal plate 441 are disconnected. Thereafter, the connector 451 is demounted from the connector metal plate 441 and then a new connector 451 is mounted on the connector metal plate 441. Thereafter, the guide frame 421 and the connector metal plate 441 are fixed with the screws 462 and 463 again. Thus, the connector 451 can be exchanged with the new connector 451.

Next, the exchange of the connector 450 will be described. Also when the connector 450 is exchanged, similarly as in the case of the connector 451, first, the controller box 600 is demounted from the frame 500 by operating the mounting arms 601.

Then, the screws 460 and 461 for fixing the guide frame 420 and the connector metal plate 440 are disconnected. Here, as regards the screw 460, the screw 460 can be disconnected by causing a screw driver 700 to access the screw 460 from above the controller box 600.

Figure 7:
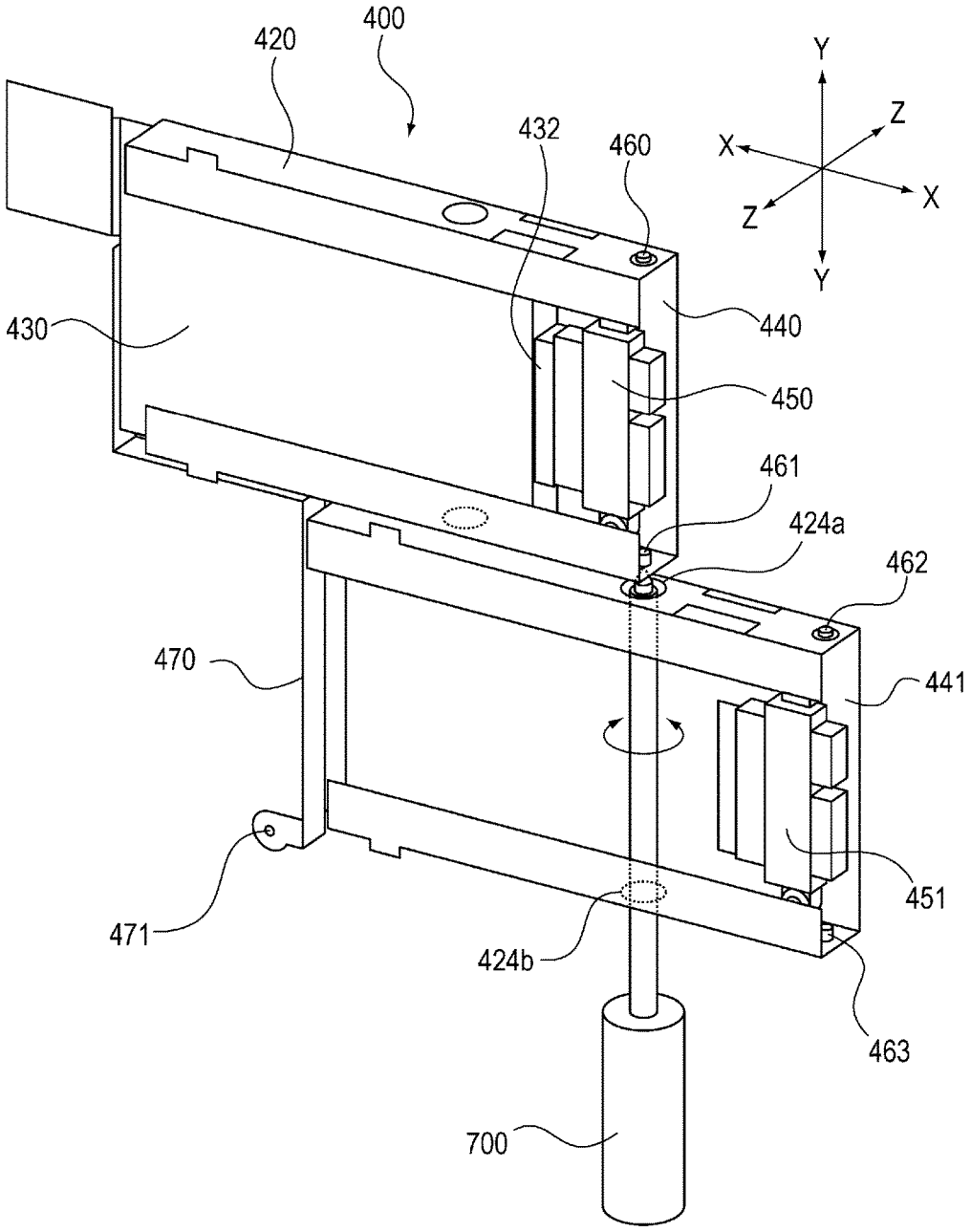
FIG. 7 is a perspective view of the HDD unit when a screw is disconnected.

FIG. 7 is a perspective view of the HDD unit 400 when the screw 461 is disconnected. As shown in FIG. 7, when the screw 461 is disconnected, the driver 700 is caused to access the screw 461 via the through holes 424*a* and 424*b* formed in the guide frame 421. As a result, the connector 450 can be exchanged without demounting the guide frame 421. Incidentally, in the case where the HDD 431 is inserted in the guide frame 421, the driver 700 has access to the screw 461 by extracting the HDD 431 from the guide frame 421.

That is, in the case where the guide frame 421 is not provided with the through holes 424*a* and 424*b* or in the case where the connectors 450 and 451 are disposed in an overlapping position as seen in the vertical direction, the driver 700 cannot be caused to access the screw 461 unless the guide frame 421 is demounted. On the other hand, in this embodiment, the connector 451 is disposed by being shifted in the horizontal direction so as not to overlap with the connector 450 as seen in the vertical direction, and the guide frame 421 is provided with the through holes 424*a* and 424*b* at positions overlapping with the connector 450 as seen in the vertical direction. Accordingly, in a state in which the guide frame 421 is fixed, the driver 700 can be caused to access the screw 461 through the through holes 424*a* and 424*b*. For this reason, the number of steps during exchange of the connector 450 can be reduced, so that exchange operativity of the connector 450 can be improved.

Figure 9:
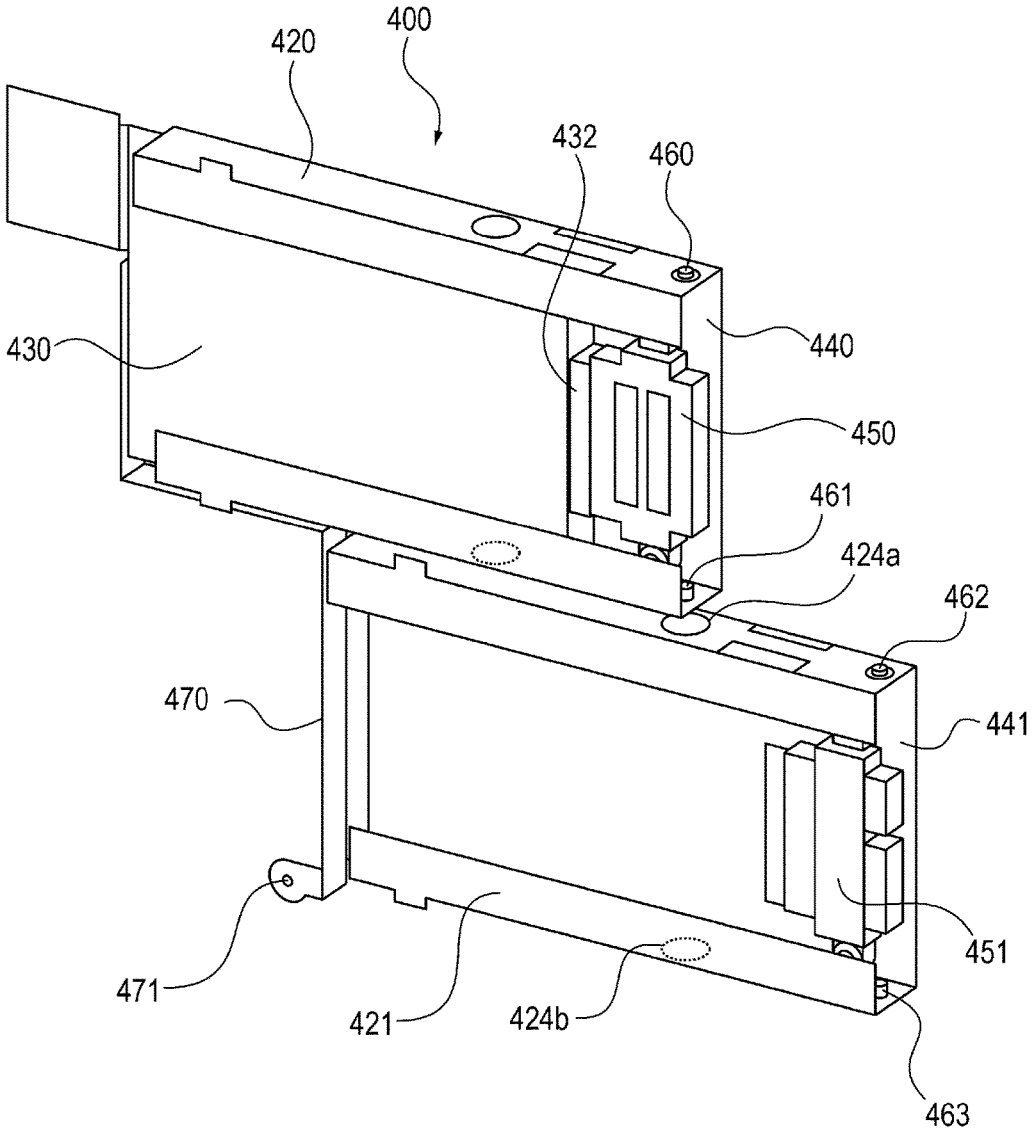
FIG. 9 is a perspective view of the HDD unit after a connector is exchanged.

Then, as shown in FIG. 8, the screws 460 and 461 are disconnected and thereafter the connector metal plate 440 is demounted from the guide frame 420. Thereafter, the connector 450 is demounted from the connector metal plate 440 and then a new connector 450 is mounted on the connector metal plate 440. Then, as shown in FIG. 9, the guide frame 420 and the connector metal plate 440 are fixed with the screws 460 and 461 again. Thereafter, the controller box 600 is mounted on the frame 500 (FIG. 2). Thus, the connector 450 can be exchanged with the new connector 450.

Incidentally, in this embodiment, the lower guide frame 421 is disposed at a position shifted to a side downstream of the upper guide frame 420 with respect to the inserting direction of the hard disk drive 431, and also the connector 451 is disposed at a position shifted similarly from the connector 450. However, the present invention is not limited thereto.

Figure 10:
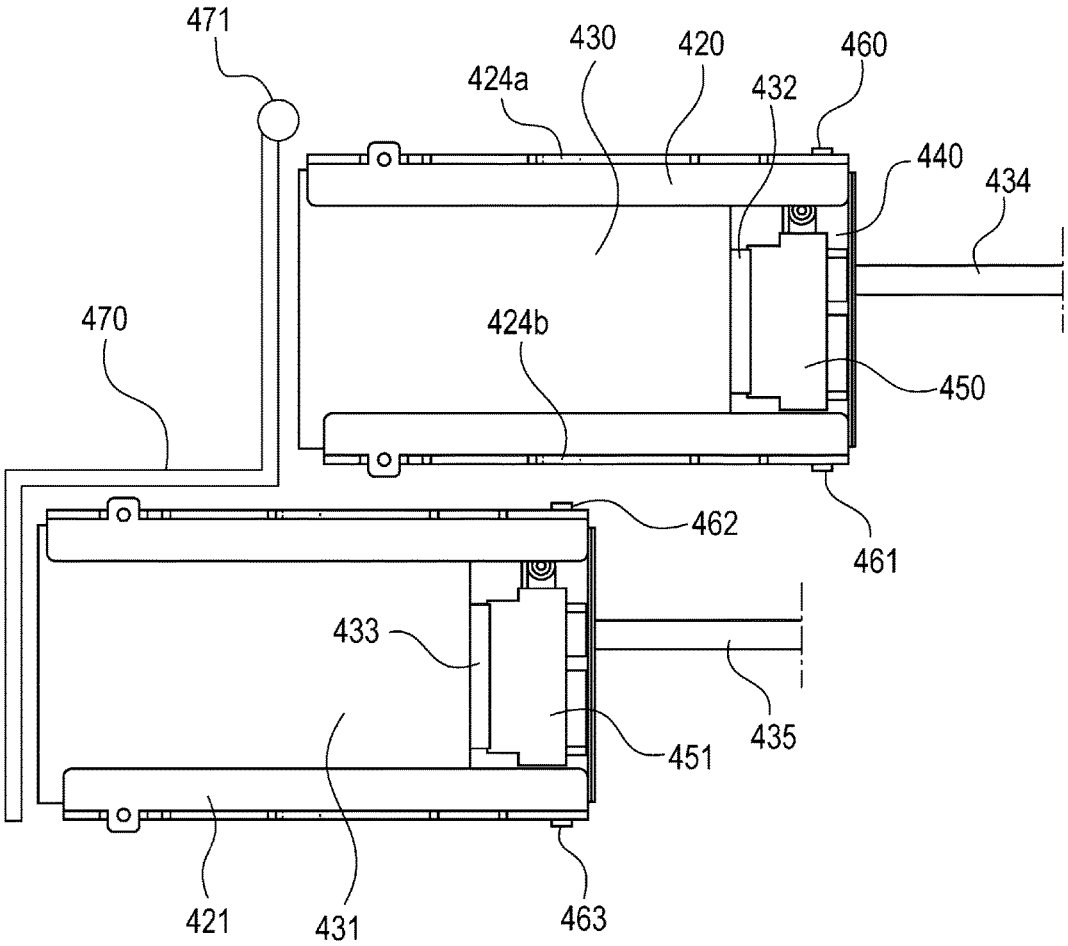
FIG. 10 is a schematic view showing a structure of another hard disk drive.
Figure 11:
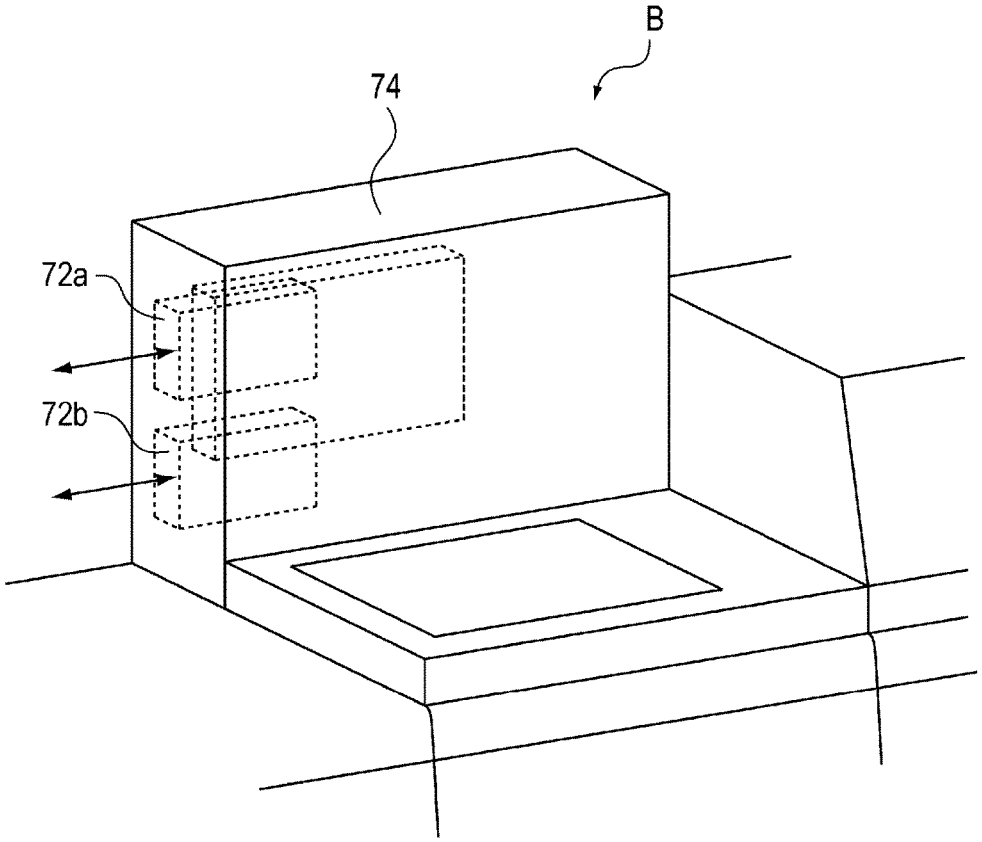
FIG. 11 is a perspective view showing a structure of a conventional image forming apparatus.

That is, as shown in FIG. 10, a constitution in which the upper guide frame 420 is disposed at a position shifted to a side downstream of the lower guide frame 421 with respect to the inserting direction of the HDD 430 may also be employed. In this case, the upper guide frame 420 is provided with the through holes 424*a* and 424*b*, through which the driver 700 can pass at positions overlapping with the connector 451 as seen in the vertical direction. As a result, in a state in which the guide frame 420 is fixed, the driver 700 can be caused to access the screw 462 through the through holes 424*a* and 424*b*. For this reason, the number of steps during exchange of the connector 451 can be reduced, so that exchange operativity of the connector 451 can be improved.

Further, in the case of this constitution, the supporting shaft 471 which is the rotation center of the door 470 is disposed at a position above the guide frame 421 and is disposed at the position downstream with respect to the inserting direction, of the upstream end surface of the HDD 431 mounted in the guide frame 421 with respect to the inserting direction. As a result, only by rotating the door 470 by 90°, the door 470 can be escaped from the insertion and extraction locus of the HDDs 430 and 431, so that the HDDs 430 and 431 can be inserted into and extracted from the guide frames 420 and 421, respectively. Accordingly, the insertion and extraction of the HDDs 430 and 431 can be performed in a state in which the rotation angle of the door 470 is small, so that the operativity is improved and space saving can be realized.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-184730 filed on Sep. 26, 2017, which is hereby incorporated by reference herein in its entirety.

What is claimed is:

1. An image forming apparatus comprising:

a controller substrate configured to control an image forming portion for forming an image;

a first mounting portion configured to mount a first hard disk drive for storing data, wherein the first hard disk is mounted to said first mounting portion by inserting the first hard disk drive in a direction across a vertical direction;

a second mounting portion configured to mount a second hard disk drive for storing data;

a first connector configured to electrically connect said controller substrate and the first hard disk drive mounted in said first mounting portion a second connector configured to electrically connect said controller substrate and the second hard disk drive mounted in said second mounting portion; and a connector holding portion which holds said first connector and which is fixed to said first mounting portion by a screw such that said first connector is downstream of an inserting entrance of said first mounting portion in an inserting direction of the first hard disk drive, wherein said first mounting portion and said second mounting portion are arranged in a vertical direction such that, as viewed in the vertical direction, said first connector overlaps with the second hard disk drive mounted in said second mounting portion, and wherein said second mounting portion is provided with a through portion through which a part of a tool for threading and unthreading the screw relative to said first mounting portion passes from a space in which the second hard disk drive is placed toward a portion of said first mounting portion where the screw is threaded.

2. The image forming operators according to claim 1, wherein said second mounting portion comprises a metal plate, and said through portion is provided in a wall of said second mounting portion which is between said first connector and said second mounting portion in the vertical direction.

3. The image forming operators according to claim 2, wherein said through portion is a through hole partly defined by the wall, and said through hole is opposed to a portion of said first mounting portion where the screw is threaded, in the vertical direction.

4. The image forming apparatus according to claim 1, wherein the second hard disk drive is mounted to said second mounting portion by inserting the second hard disk drive in the inserting direction of the first hard disc drive.

5. The image forming operators according to claim 4, wherein in the inserting direction, said second connector is downstream of said first connector.

6. The image forming operators according to claim 5, wherein, in the inserting direction, an inserting entrance of said second mounting portion for the second hard disk drive is upstream of the inserting entrance of said first mounting portion.

7. The image forming operators according to claim 6, further comprising a second connector holding portion configured to hold said second connector, wherein said second connector holding portion is fixed to said second mounting portion by a screw such that said second connector is downstream of the inserting entrance of said second mounting portion in the inserting direction of the second hard disk drive.

8. The image forming apparatus according to claim 6, further comprising a cover member rotatably supported by a main assembly of said image forming apparatus and movable between a closed position where said cover member covers the inserting entrance of said first mounting portion and the inserting entrance of said second mounting portion, and an open position where said cover member is opened so that the first hard disk drive and the second hard disk drive are insertable to and extractable from said first mounting portion and said second mounting portion, respectively.

9. The image forming apparatus according to claim 8, wherein said cover member includes a first cover portion configured to cover the inserting entrance of said first mounting portion and a second cover portion configured to cover the inserting entrance of said second mounting portion, wherein said cover member has a shape such that, in the closed position, said second cover portion is between the inserting entrance of said first mounting portion and the inserting entrance of said second mounting portion in the inserting portion.

10. The image forming operators according to claim 9, further comprising a supporting shaft configured to rotatably support said the cover member, wherein said first mounting portion is above said second mounting portion in the vertical direction, and said supporting shaft is below said second cover portion in the vertical direction.

11. The image forming operators according to claim 9, further comprising a supporting shaft configured to rotatably support said cover member, wherein said first mounting portion is below said second mounting portion in the vertical direction, and said supporting shaft is above said second cover portion in the vertical direction.

12. The image forming operators according to claim 1, wherein said first mounting portion is a guide frame configured to connect a connector of said first hard disk drive to said first connector when the first hard disk drive is mounted to said first mounting portion, and wherein said second mounting portion is a guide frame configured to connect a connector of the second hard disk drive to said second connector when the second hard disk drive is mounted to said second mounting portion.

13. An image forming apparatus comprising:

a controller substrate configured to control an image forming portion for forming an image;

a first mounting portion configured to mount a first hard disk drive for storing data, wherein the first hard disk drive is mounted to said first mounting portion by inserting the first hard disk drive;

a second mounting portion configured to mount a second hard disk drive for storing data;

a first connector configured to electrically connect said controller substrate and the first hard disk drive mounted in said first mounting portion;

a second connector configured to electrically connect said controller substrate and the second hard disk drive mounted in said second mounting portion; and a connector holding portion which holds said first connector and which is fixed to said first mounting portion by a screw such that said first connector is downstream of an inserting entrance of said first mounting portion in an inserting direction of the first hard disk drive, wherein as viewed in the inserting direction, said first mounting portion and said second mounting portion are disposed adjacent to each other, wherein as viewed in a direction in which said first mounting portion and said second mounting portion are arranged, said first connecting portion overlaps the second hard disk drive mounted to said second mounting portion, and wherein said second mounting portion is provided with a through portion through which a part of a tool for threading and unthreading the screw relative to said first mounting portion passes from a space in which the second hard disk drive is placed toward a portion of said first mounting portion where the screw is threaded.

14. The image forming operators according to claim 13, wherein said second mounting portion comprises a metal plate, and said through portion is provided in a wall of said second mounting portion which is between said first connector and said second mounting portion as viewed in the arrangement direction.

15. The image forming operators according to claim 14, wherein said through portion is a through hole partly defined by the wall, and said through hole is opposed to a portion of said first mounting portion where the screw is threaded, in the arrangement direction.

16. The image forming apparatus according to claim 13, wherein the second hard disk drive is mounted to said second mounting portion by inserting the second hard disk drive in the inserting direction of the first hard disk drive.

17. The image forming operators according to claim 16, wherein in the inserting direction, said second connector is downstream of said first connector.

18. The image forming operators according to claim 17, wherein in the inserting direction, an inserting entrance of said second mounting portion for the second hard disk drive is upstream of the inserting entrance of said first mounting portion.

19. The image forming operators according to claim 13, wherein said first mounting portion is a guide frame configured to connect a connector of said first hard disk drive to said first connector when the first hard disk drive is mounted to said first mounting portion, and wherein said second mounting portion is a guide frame configured to connect a connector of the second hard disk drive to said second connector when the second hard disk drive is mounted to said second mounting portion.

* * * * *